United States Patent [19]

Sulprizio

[11] Patent Number: 4,815,518

[45] Date of Patent: Mar. 28, 1989

[54] CASTING MACHINE

[76] Inventor: Lucelio Sulprizio, 3059 Frandoras Cir., Oakley, Calif. 94561

[21] Appl. No.: 80,793

[22] Filed: Aug. 3, 1987

[51] Int. Cl.[4] ..... B22D 17/22; B22D 17/24

[52] U.S. Cl. ..... 164/412; 164/341; 164/342; 425/190; 425/451.3; 425/589

[58] Field of Search ..... 164/341, 342, 343, 412; 425/190, 451.3, 451.9, 589, 595

[56] References Cited

U.S. PATENT DOCUMENTS

| | | | |
|---|---|---|---|
| 828,767 | 8/1906 | Palmer | 425/451.3 |
| 1,776,591 | 9/1930 | Liers | 164/342 |
| 1,833,659 | 11/1931 | Ravenschlag et al. | 164/342 |
| 4,206,799 | 6/1980 | McDonald | 425/451.9 |

*Primary Examiner*—M. Jordan
*Assistant Examiner*—Richard K. Seidel
*Attorney, Agent, or Firm*—I. Michael Bak-Boychuk

[57] ABSTRACT

A casting bench useful in casting limited quantities of articles includes a top base plate grooved longitudinally to receive opposed sliding cages each advanced by a corresponding first rack assembly. Each sliding cage, moreover, carries with it a corresponding second rack assembly useful in advancing lateral core plugs. Thus, exterior casting forms may be fixed to the sliding cages which then advance the cores for casting. The base plate may be releasably fixed to support legs and the whole structure may be disassembled for storage.

4 Claims, 2 Drawing Sheets

CASTING MACHINE

BACKGROUND OF THE INVENTION

1. Field of the Invention

The present invention relates to casting machines, and more particularly to an articulated casting assembly useful in limited production of special purpose castings.

2. Description of the Prior Art

In the art of metal casting various devices have been developed for advancing and withdrawing mold sections and core plugs. Most frequently such devices address the problems of mass production and consequence do not accommodate the flexibility and convenience required by those engaged in singular molding processes such as those engaged to produce prototypes or limited production castings.

The problems of a prototype producer are distinctly different from the problems of mass production and the limited producer, for example, is more interested in tool convenience and flexibility over quantity output. Moreover, a limited casting producer will often resort to molds conveniently made and sand molds are thus often utilized in such applications. Accordingly, those engaged in prototype work often require tools for the manipulation of heavy mold sections and core plugs, movement for articulation which conveniently adapt to various molds. Simply, those engaged in limited production require tools of wide flexibility both to conserve costs and equipment repertoire.

In the past, articulated casting molds were devised such as those exemplified in U.S. Pat. Nos. 1,776,591 to Liers, 1,872,085 to Korsmo and the Soviet Union Pat. No. 835621 to Tabensky. Each of those prior references, while suitable for their purposes, address a singular or a single species of mold configuration and therefore lack the requisite flexibility contemplated herein. Flexible, generally useful and fully articulated molding and/or casting assemblies are therefore desired and it is one such assembly that is disclosed herein.

SUMMARY OF THE INVENTION

Accordingly, it is the general purpose and object of the present invention to provide an articulated casting bench useful with various mold configurations.

Other objects of the invention are to provide a casting bench conformed for manual articulation.

Yet further objects of the invention are to provide a casting bench conformed for convenient disassembly and storage.

Briefly, these other objects are accomplished within the present invention by providing a substantially rectangular base plate supported by legs at each corner thereof, each leg including at its upper end a vertical guide plate between which a dual rack assembly is fixed. Each dual rack assembly, moreover, extends to engage a corresponding sliding cage for advancement along the base plate by the articulation of the dual rack. This sliding cage, furthermore, supports a corresponding single rack assembly which is then useful to articulate plugs and cores in the manipulation thereof. Formed centrally in the base plate is a recessed opening into which further core plugs may be engaged.

Thus, the sliding cages are deployed for articulation towards each other advancing the mold cavity sections in the course of the sliding thereof. Moreover, the cages concurrently carry along with them the engaged single core plug racks which can then fix the core plug once the casting cavity is joined. In this manner an articulated casting bench is devised including provisions for the manipulation of various cores and plugs in the course of casting.

For storage convenience the base plate may be releasably fixed to the leg assemblies and when not in use may be disassembled and stacked away. Thus, a convenient casting tool is devised which is particularly useful for those engaged in low volume, special purpose casting.

DESCRIPTION OF THE PREFERRED EMBODIMENT

Figure 1:
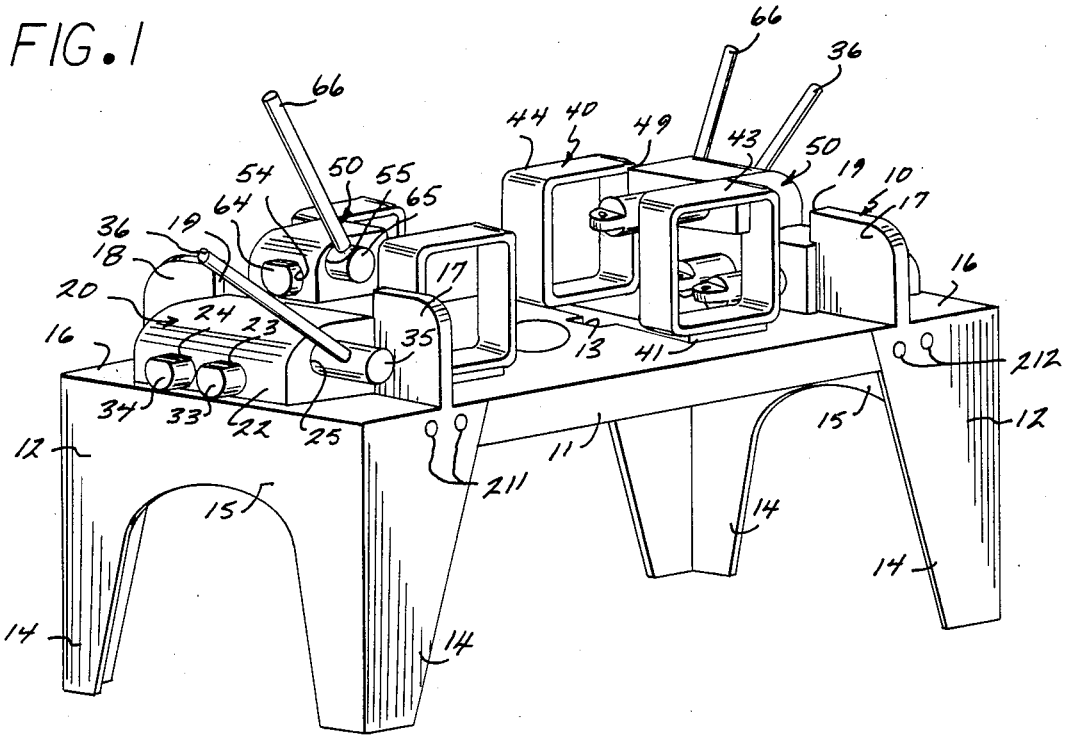
FIG. 1 is a perspective illustration of the inventive casting bench conformed for receipt of casting mold pieces.
Figure 3:
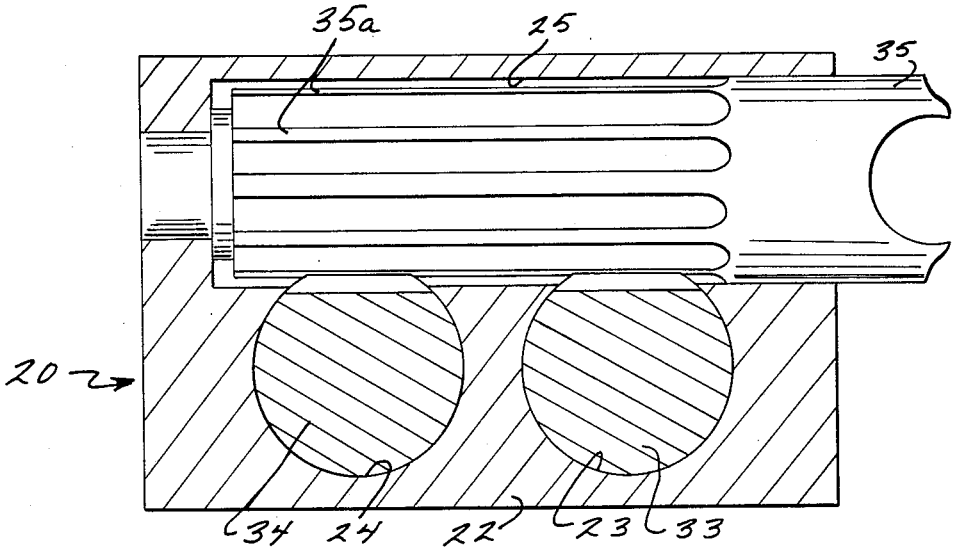
FIG. 3 is a sectional view taken along line 3—3 of FIG. 4.
Figure 2:
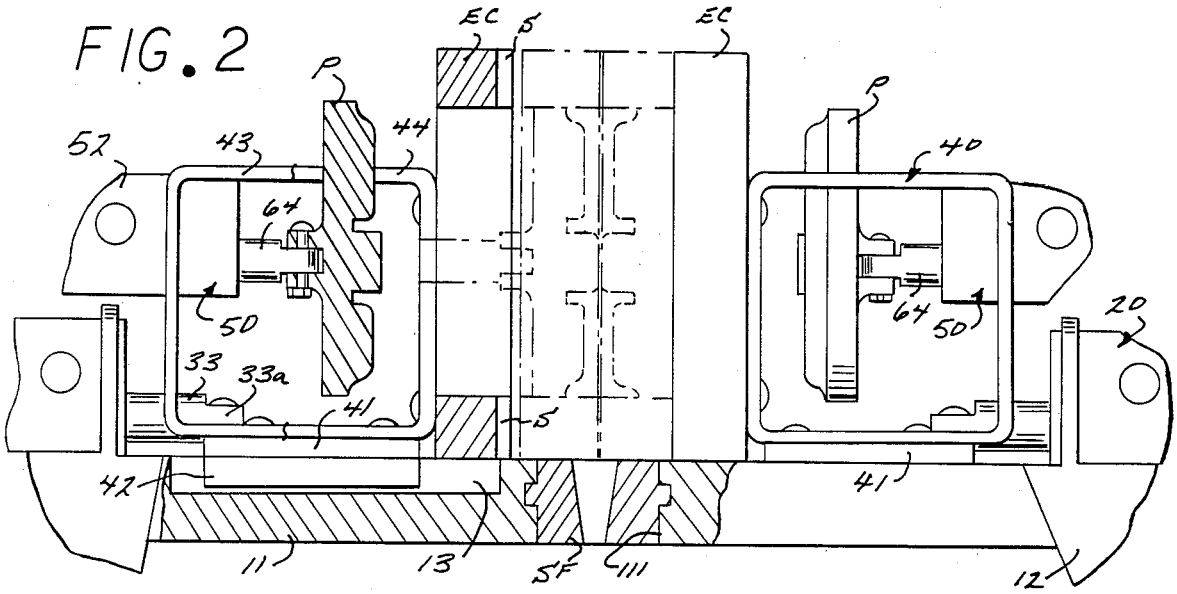
FIG. 2 is a side view detail, in partial section, of the bench shown in FIG. 1.
Figure 4:
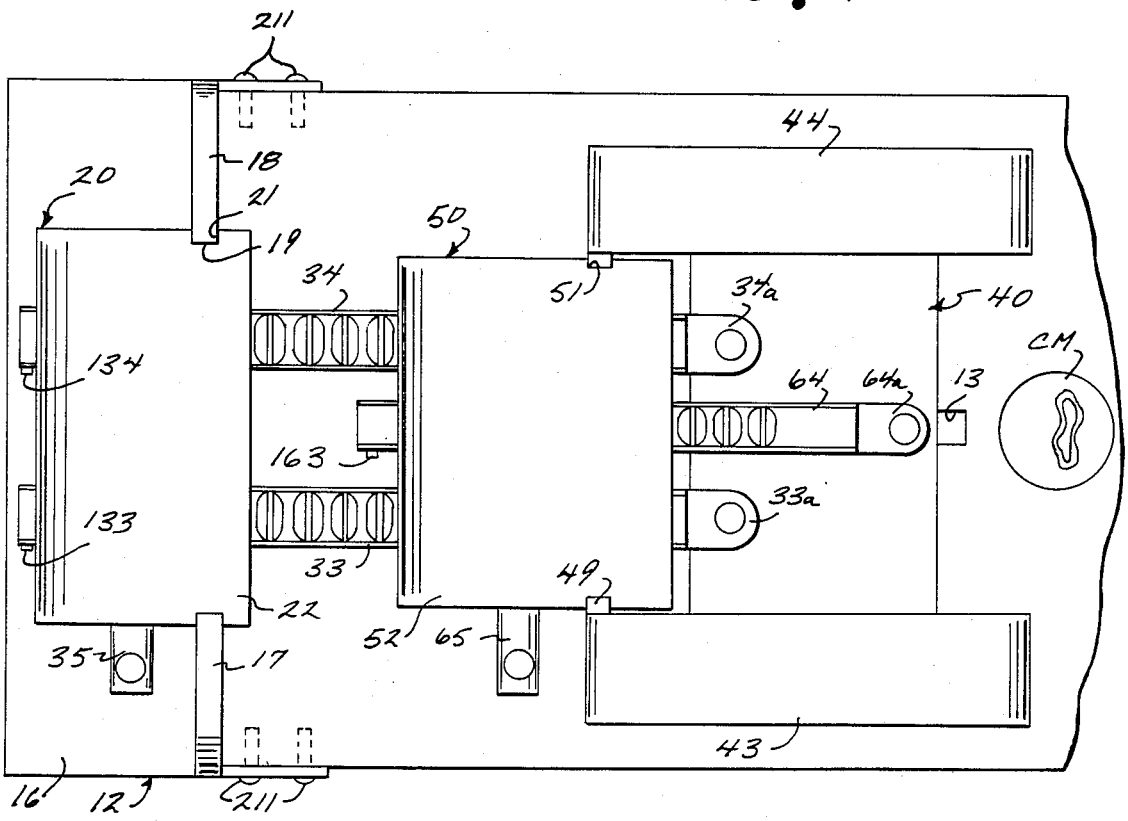
FIG. 4 is a top view detail of the bench disclosed herein.

As shown in FIGS. 1 through 4 the inventive casting bench, generally designated by the numeral 10, comprises a thermally massive, substantially rectangular top plate 11 attached at either end to a leg assembly 12, each such leg assembly including a pair of L-sectioned legs 14 joined to each other by a web 15. The common top edge of legs 14 and web 15, in turn, join to a horizontal shelf surface 16 from which two coplanar, vertically aligned, attachment plates 17 and 18 extend above the shelf surface. Plates 17 and 18 include adjacent vertical edges aligned towards each other to form a rectangular retention aperture 19 engageable in a groove 21 formed along one side of a rack assembly 20.

Rack assembly 20 includes a housing 22 provided with two parallel, adjacent rack bores 23 and 24 extending orthogonally into the recessed side and a transverse pinion drilling 25 aligned thereacross. Two substantially cylindrical racks 33 and 34 are then inserted into bores 23 and 24 for common engagement with the pinion teeth 35*a* formed on the exterior of a pinion shaft 35 received in bore 25. Shaft 35 then extends to the exterior of the housing 22 for engagement with a handle 36.

In this form rack 33 and 34 extend through the aperture 19 to align over the surface of plate 11. A sliding cage, generally at 40, engaged by dovetail engagement in a longitudinal slot 13 formed in plate 11 is then pinned to the projecting ends 33*a* and 34*a* of the racks 33 and 34. Cage 40 is generally characterized by a bottom plate 41 provided with a dovetail longitudinal projection 42 which, as referred to above, engages slot 13. Two substantially rectangular frames 43 and 44 are vertically fixed to the bottom plate in parallel longitudinal alignment, once again forming a rectangular retention recess or aperture 49 therebetween for engagement by a groove 51 in yet another rack and pinion assembly 50. Assembly 50, similar to assembly 20, includes a single longitudinal rack drilling 54 formed in a housing 52 and aligned along an axis passing between the parallel frames 43 and 44. An orthogonal pinion drilling 55 extends across the housing in proximate intersecting spacing with the drilling 54. A rack cylinder 64 is then received within the drilling 54 for engagement with the pinion teeth on a pinion rod 65. Once again rod 65 extends to the exterior of the housing for engagement with a handle bar 66.

In this manner the advancement of the cage 40 is controlled by manual rotation of the pinion 35. An exterior casting cavity EC fixed to the frames 43 and 44 is thus advanced over the surface of the plate 11. A symmetrical and like numbered structure is similarly provided at the other end advancing the mating part of the casting cavity towards each other. The rack assembly 50 then carried along with the cage is useful to insert a core or plug P, fixed to the opposing ends of rack cylinders 63, into the casting cavity EC. Of course appropriate sprues S and other pathways are provided in the cavity EC for receiving and relieving molten metal in the mold thus formed.

For convenience in gravity casting and for mounting further plugs or cores the top plate 11 includes central therein a mounting aperture 111 in which a drain sprue fixture SF or a core mount CM may be received. Racks 33, 34 and 63, of course, may be provided with various stroke limiting pinnings 133, 134 and 163 and thus are geometrically controlled to align the resulting parting plane at the aperture. Accordingly, pinion 35 advances in common racks 33 and 34 which attack at their ends **33*a* and 34*a* to the cage assembly 40. This rack assembly includes the rectangular transverse aperture 49 the edges of which are received in the grooves 51 formed in the pinion assembly 50. Thus, the cage assembly 40 is advanced along groove 13 carrying along with it the pinion assembly 50 and the exterior casting form EC fixed to the frames 43 and 44. When the casting cavity EC is brought into position then the rack assembly 50 may be used to advance the plug P attached to the end of rack 64**. In consequence several pieces combining into a single casting form can be brought together.

For convenience in storage both leg assemblies 12 may be pinned or otherwise secured to the base plate 11 by way of fasteners 211 and 212 with the plate extending into the leg assemblies. Thus, when not used the plate may be separated from the legs and the separated items stored on edge adjacent a wall to limit the necessity of unused floor space.

In consequence a convenient and extensively useful casting bench is devised which will accommodate various casting and core shapes.

Obviously, many modifications and changes may be made to the foregoing without departing from the spirit of the invention. It is therefore intended that the scope of the invention be determined solely on the claims appended hereto.

What is claimed is:

1. A casting bench comprising:

a substantially rectangular base plate characterized by an upper and a lower surface, and a right and left end including grooves extending longitudinally between said right and left end in said upper surface;

a right and left cage conformed for sliding on said upper surface and slidably engaged in said grooves;

a first right and left rack and pinion block respectively fixed to said plate adjacent said right and left ends thereof, each including extendable racks respectively connected to said right and left cages for advancement thereof on said plate;

a second right and left rack and pinion block respectively mounted on said right and left cage for extending corresponding rack shafts relative said right and left cages; and a right and left leg assembly each releasably engaged to said right and left ends for supporting said base plate.

2. Apparatus according to claim 1, wherein:

each said right and left cage comprises a framework including a rectangular transverse recess for receiving the corresponding one of said second right and left rack and pinion block.

3. Apparatus according to claim 2, wherein:

said plate includes a core mount in said upper surface aligned intermediate said right and left cages.

4. Apparatus according to claim 3, wherein:

said right and left cages include means for engaging exterior casting forms; and said second right and left blocks include means for engaging corresponding lateral cores.

* * * * *